US009378677B2

(12) United States Patent
Toyomura

(10) Patent No.: US 9,378,677 B2
(45) Date of Patent: Jun. 28, 2016

(54) DRIVE CIRCUIT, DISPLAY UNIT, AND ELECTRONIC APPARATUS

(71) Applicant: JOLED Inc., Tokyo (JP)

(72) Inventor: Naobumi Toyomura, Kanagawa (JP)

(73) Assignee: JOLED Inc., Tokyo (JP)

( * ) Notice: Subject to any disclaimer, the term of this patent is extended or adjusted under 35 U.S.C. 154(b) by 6 days.

(21) Appl. No.: 14/498,199

(22) Filed: Sep. 26, 2014

(65) Prior Publication Data

US 2015/0123960 A1 May 7, 2015

(30) Foreign Application Priority Data

Nov. 16, 2013 (JP) ..... 2013-230546

(51) Int. Cl.
*G09G 3/32* (2016.01)

(52) U.S. Cl.
CPC ..... *G09G 3/3233* (2013.01); *G09G 2300/0819* (2013.01); *G09G 2300/0842* (2013.01)

(58) Field of Classification Search
None
See application file for complete search history.

(56) References Cited

U.S. PATENT DOCUMENTS

2008/0224964 A1* 9/2008 Tanikame ..... G09G 3/3233 345/76
2012/0162188 A1* 6/2012 Yamashita ..... G09G 3/20 345/212

FOREIGN PATENT DOCUMENTS

JP 2012-137513 7/2012

* cited by examiner

*Primary Examiner* — Dwayne Bost
*Assistant Examiner* — Christopher Kohlman
(74) *Attorney, Agent, or Firm* — Michael Best & Friedrich LLP

(57) ABSTRACT

A display unit includes: a display panel; and a drive circuit. The display panel includes pixels arranged in a matrix, signal lines configured to supply a data pulse to the respective pixels, scan lines configured to supply a selection pulse to the respective pixels, the selection pulse selecting the respective pixels for each row, and power lines configured to supply power to the respective pixels. The drive circuit includes a signal line drive circuit configured to output the data pulse to each of the signal lines, a scan line drive circuit configured to sequentially output the selection pulse to each of the scan lines, and a power circuit configured to continuously output a constant voltage to the power lines. The data pulse is formed of a signal voltage and one of a first fixed voltage and a second fixed voltage, the signal voltage based on a picture signal.

9 Claims, 14 Drawing Sheets

DRIVE CIRCUIT, DISPLAY UNIT, AND ELECTRONIC APPARATUS

CROSS REFERENCE TO RELATED APPLICATIONS

This application claims the benefit of Japanese Priority Patent Application JP 2013-230546 filed Nov. 6, 2013, the entire contents of which are incorporated herein by reference.

BACKGROUND

The present disclosure relates to a drive circuit allowing an extra space for a timing margin, and a display unit and an electronic apparatus each provided with the drive circuit.

In a field of display units performing picture display, a display unit using, as a light emitting element of a pixel, a current drive type optical element whose light emission luminance is varied in response to a value of a flowing current, for example, an organic electro luminescence (EL) element, has been developed and commercialization thereof is progressing. Unlike a liquid crystal element, the organic EL element is a self light emitting element. Therefore, since a light source (a backlight) is unnecessary in the display unit using the organic EL element (an organic EL display unit), the display unit is allowed to be reduced in weight, in thickness, and improved in luminance, as compared with a liquid crystal display unit demanding a light source. Further, since a response speed of the organic EL element is about several μs, which is extremely high, an after image during moving picture display does not occur. Accordingly, the organic EL display unit is expected to be a mainstream of next generation flat panel display.

In the organic EL display unit, the drive method thereof includes a simple (passive) matrix method and an active matrix method, as with the liquid crystal display unit. The former has a simple configuration; however, has a difficulty to achieve a large display unit with high definition. Therefore, development of the active matrix method has been actively carried out. In this method, a current flowing through an organic EL element arranged for each pixel is controlled by a drive transistor in a pixel circuit that is provided for each organic EL element.

In the active matrix organic EL display unit, the scan lines are sequentially scanned and a signal voltage based on a picture signal is sampled and written to a retention capacitance, in every horizontal period (1H). In other words, writing operation of the signal voltage is performed by linear sequential scanning of 1H period. Moreover, in the organic EL display unit, when a threshold voltage and a mobility of the drive transistor are varied for each pixel, light emission luminance of organic EL element is varied and uniformity of a screen is impaired. Therefore, in the active matrix organic EL display unit, correction operation to reduce variation of light emission luminance caused by variation of the threshold voltage and the mobility of the drive transistor is performed together with the linear sequential scanning of 1H period.

In the active matrix organic EL display unit, a large current is allowed to flow through power lines because power is supplied to the pixels through the respective power lines. However, a pulse power controlling light emission and light extinction of the organic EL element is normally applied to the power lines. Therefore, the scale of the power line drive circuit becomes extremely large, and the bezel of the display panel including the power line drive circuit therein becomes large as well. Therefore, for example, as described in Japanese Unexamined Patent Application Publication No. 2012-137513, it is proposed that the voltage of the power lines is fixed, and the data pulse applied to the signal lines is formed of a waveform having three values in 1H.

SUMMARY

However, a time period of 1H is decreased in association with increase in resolution in recent years. Therefore, by the method described in Japanese Unexamined Patent Application Publication No. 2012-137513, timing margin may be lacked and uniformity may be impaired due to wiring transient.

It is desirable to provide a drive circuit capable of reducing impairing in uniformity in association with reduction in size of a bezel, and a display unit and an electronic apparatus each provided with the drive circuit.

According to an embodiment of the technology, there is provided a drive circuit configured to drive a display panel. The display panel includes a plurality of pixels arranged in a matrix, signal lines configured to supply a data pulse to the respective pixels, scan lines configured to supply a selection pulse to the respective pixels, the selection pulse selecting the respective pixels for each row, and power lines configured to supply power to the respective pixels. The drive circuit includes: a signal line drive circuit configured to output the data pulse to each of the signal lines for each horizontal period; a scan line drive circuit configured to sequentially output the selection pulse to each of the scan lines during one frame period; and a power circuit configured to continuously output a constant voltage to the power lines during one frame period. The data pulse is formed of a signal voltage and one of a first fixed voltage and a second fixed voltage, the signal voltage based on a picture signal, and the first fixed voltage being smaller than the second fixed voltage.

According to an embodiment of the technology, there is provided a display unit including: a display panel; and a drive circuit configured to drive the display panel. The display panel includes a plurality of pixels arranged in a matrix, signal lines configured to supply a data pulse to the respective pixels, scan lines configured to supply a selection pulse to the respective pixels, the selection pulse selecting the respective pixels for each row, and power lines configured to supply power to the respective pixels. The drive circuit includes a signal line drive circuit configured to output the data pulse to each of the signal lines for each horizontal period, a scan line drive circuit configured to sequentially output the selection pulse to each of the scan lines during one frame period, and a power circuit configured to continuously output a constant voltage to the power lines during one frame period. The data pulse is formed of a signal voltage and one of a first fixed voltage and a second fixed voltage, the signal voltage based on a picture signal, and the first fixed voltage being smaller than the second fixed voltage.

According to an embodiment of the technology, there is provided an electronic apparatus provided with a display unit. The display unit includes: a display panel; and a drive circuit configured to drive the display panel. The display panel includes a plurality of pixels arranged in a matrix, signal lines configured to supply a data pulse to the respective pixels, scan lines configured to supply a selection pulse to the respective pixels, the selection pulse selecting the respective pixels for each row, and power lines configured to supply power to the respective pixels. The drive circuit includes a signal line drive circuit configured to output the data pulse to each of the signal lines for each horizontal period, a scan line drive circuit configured to sequentially output the selection pulse to each of the scan lines during one frame period, and a power circuit configured to continuously output a constant voltage to the power lines during one frame period. The data pulse is formed of a signal voltage and one of a first fixed voltage and a second fixed voltage, the signal voltage based on a picture signal, and the first fixed voltage being smaller than the second fixed voltage.

In the drive circuit, the display unit, and the electronic apparatus according to the respective embodiments of the technology, the data pulse output to each of the signal lines in every horizontal period is configured of the signal voltage based on the picture signal and one of the first fixed voltage and the second fixed voltage (the first fixed voltage<the second fixed voltage). Accordingly, as compared with the case where the data pulse is configured of the signal voltage, the first fixed voltage, and the second fixed voltage, it is possible to make a period during which the voltages are output to the respective signal lines long.

According to the drive circuit, the display unit, and the electronic apparatus according to the respective embodiments of the technology, the period during which the voltages are output to the respective signal lines is longer than that in the case where the data pulse is configured of the signal voltage, the first fixed voltage, and the second fixed voltage. Therefore, when the voltage of the power lines is fixed, it is possible to reduce possibility that the timing margin is lacked. Consequently, it is possible to reduce possibility that uniformity is impaired in association with reduction in the size of the bezel.

It is to be understood that both the foregoing general description and the following detailed description are exemplary, and are intended to provide further explanation of the technology as claimed.

BRIEF DESCRIPTION OF THE DRAWINGS

The accompanying drawings are included to provide a further understanding of the disclosure, and are incorporated in and constitute a part of this specification. The drawings illustrate embodiments and, together with the specification, serve to explain the principles of the technology.

FIG. 3 is a waveform diagram illustrating an example of temporal change of voltages applied to a signal line DTL, a scan line WSL, and a power line DSL and voltages of nodes when one pixel is focused on.

DETAILED DESCRIPTION

Hereinafter, an embodiment of the technology will be described in detail with reference to drawings. Note that description thereof will be given in the following order.

1. Embodiment (Display Unit)
2. Modification (Display Unit)
3. Application Examples (Electronic Apparatuses)

<1. EMBODIMENT>

(Configuration)

Figure 1:
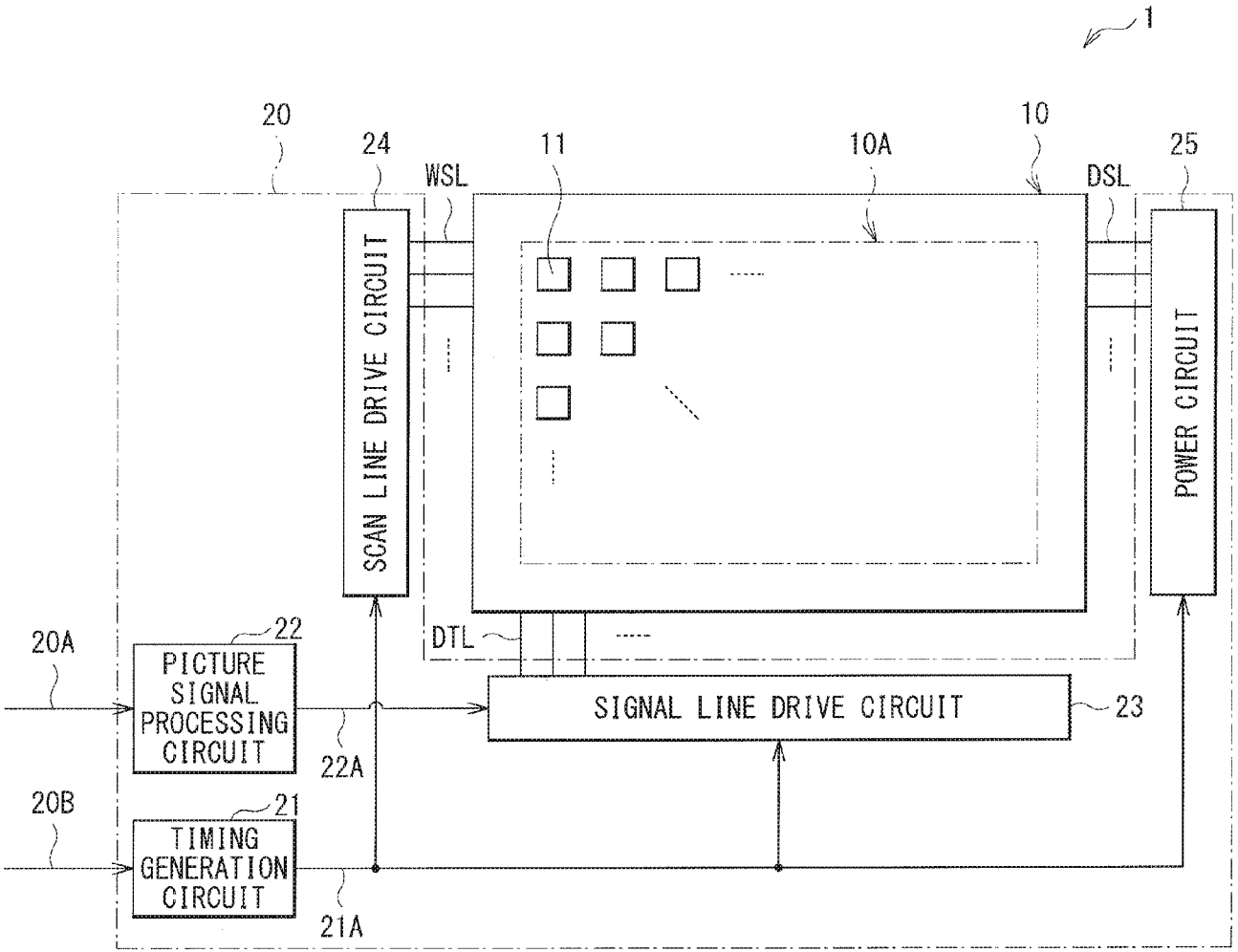
FIG. 1 is a schematic configuration diagram of a display unit according to an embodiment of the technology.

FIG. 1 illustrates a schematic configuration of a display unit 1 according to an embodiment of the technology. The display unit 1 includes a display panel 10 and a drive circuit 20 driving the display panel 10 based on a picture signal 20A and a synchronization signal 20B that are input from outside. For example, the drive circuit 20 may include a timing generation circuit 21, a picture signal processing circuit 22, a signal line drive circuit 23, a scan line drive circuit 24, and a power circuit 25.

(Display Panel 10)

The display panel 10 is configured of a plurality of pixels 11 that are arranged in a matrix over an entire display region 10A of the display panel 10. When the pixels 11 are driven by an active matrix driving method by the drive circuit 20, the display panel 10 displays an image based on the picture signal 20A input from the outside.

Figure 2:
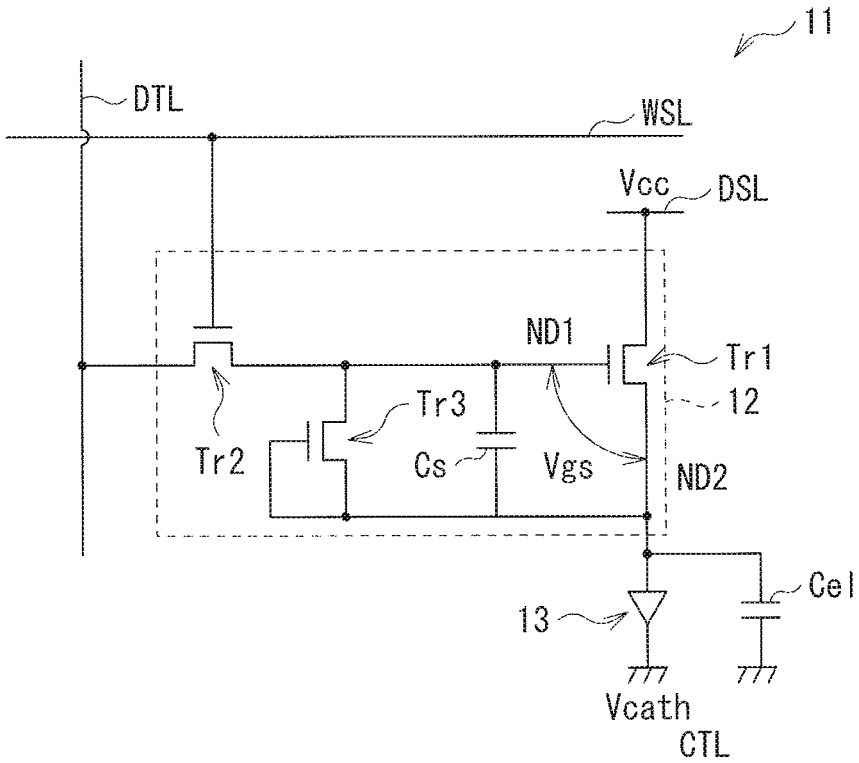
FIG. 2 is a diagram illustrating an example of a circuit configuration of each pixel.

FIG. 2 illustrates an example of a circuit configuration of the pixel 11. Each of the pixels 11 may have, for example, a pixel circuit 12 and an organic EL element 13. For example, the organic EL element 13 may have a configuration in which an anode electrode, an organic layer, and a cathode electrode are stacked in order. The organic EL element 13 has an element capacitance Ce1. The pixel circuit 12 controls light emission and light extinction of the organic EL element 13. The pixel circuit 12 has a function of retaining a voltage written into each of the pixels 11 by write scanning described later. For example, the pixel circuit 12 may be configured of a drive transistor Tr1, a write transistor Tr2, a cutoff transistor Tr3, and a retention capacitance C2, and has a circuit configuration of 3Tr1C.

The write transistor Tr2 controls application of a signal voltage to a gate of the drive transistor Tr1. The signal voltage corresponds to the picture signal. Specifically, the write transistor Tr2 samples a voltage of a signal line DTL described later, and writes the voltage of the signal line DTL to the gate of the drive transistor Tr1. The drive transistor Tr1 drives the organic EL element 13, and is connected in series to the organic EL element 13. The drive transistor Tr1 controls a current flowing through the organic EL element 13 based on magnitude of the voltage sampled by the write transistor Tr2. The cutoff transistor Tr3 performs initialization described later on the drive transistor Tr1 without light emission operation. The retention capacitance Cs retains a predetermined voltage between the gate and a source of the drive transistor Tr1. The retention capacitance Cs has a function of holding a gate-source voltage Vgs of the drive transistor Tr1 constant during a standby period described later. Note that the pixel circuit 12 may have a circuit configuration in which various capacitances and transistors are added to the above-described circuit configuration of 3Tr1C, or may have a circuit configuration different from the above-described circuit configuration of 3Tr1C.

Each of the drive transistor Tr1, the write transistor Tr2, and the cutoff transistor Tr3 may be formed of, for example, an n-channel MOS thin film transistor (TFT). Note that these transistors may be each formed of a p-channel MOS TFT. The following description will be given by assuming that these transistors are of enhancement type; however, these transistors may be of depression type. Moreover, these transistors may be of single gate type or of dual gate type.

The display panel 10 has a plurality of scan lines WSL each extending in a row direction, a plurality of signal lines DTL each extending in a column direction, a plurality of power lines DSL each extending in the row direction, and a plurality of cathode lines CTL each extending in the row direction. Incidentally, the cathode lines CTL may be formed of one common sheet metal layer. The scan lines WSL are used to select the pixel 11, and supply a selection pulse selecting the respective pixels 11 for each row to the respective pixels 11. The signal lines DTL are used to supply the signal voltage based on the picture signal, to the respective pixels 11, and supply a data pulse including the signal voltage to the respective pixels 11. The power lines DSL supply power to the respective pixels 11.

The pixel 11 is provided near an intersection between each of the signal lines DTL and each of the scan lines WSL. Each of the signal lines DTL is connected to an output end (not illustrated) of the signal line drive circuit 23 described later and to a source or a drain of the write transistor Tr2. Each of the scan lines WSL is connected to an output end (not illustrated) of the scan line drive circuit 24 described later and to a gate of the write transistor Tr2. Each of the power lines DSL is connected to an output end (not illustrated) of a power source outputting a fixed voltage and to the source or a drain of the drive transistor Tr1. For example, the cathode lines CTL may be members provided around the display region 10A, and are connected to members having a reference voltage.

The gate of the write transistor Tr2 is connected to the scan line WSL. The source or the drain of the write transistor Tr2 is connected to the signal line DTL. A terminal not connected to the signal line DTL out of the source and the drain of the write transistor Tr2 is connected to the gate of the drive transistor Tr1. The source or the drain of the drive transistor Tr1 is connected to the power line DSL. A gate terminal of the drive transistor Tr1 configures a node ND1 in FIG. 2. A source terminal (a terminal on the organic EL element 13 side in FIG. 2) of the drive transistor Tr1 configures a node ND2 in FIG. 2.

A terminal not connected to the power line DSL out of the source and the drain of the drive transistor Tr1 is connected to an anode of the organic EL element 13. A first end of the retention capacitance Cs is connected to the gate of the drive transistor Tr1. A second end of the retention capacitance Cs is connected to the source (a terminal on the organic EL element 13 side in FIG. 2) of the drive transistor Tr1. In other words, the retention capacitance Cs is interposed between the gate and the source of the drive transistor Tr1. A first end of the element capacitance Ce1 is connected to the source (the terminal on the organic EL element 13 side in FIG. 2) of the drive transistor Tr1. The cutoff transistor Tr3 is connected in parallel to the retention capacitance Cs. A gate of the cutoff transistor Tr3 is connected to a terminal of the retention capacitance Cs on the anode side of the organic EL element 13. In other words, the cutoff transistor Tr3 is diode-connected.

(Drive Circuit 20)

Next, the drive circuit 20 is described. As described above, for example, the drive circuit 20 may include the timing generation circuit 21, the picture signal processing circuit 22, the signal line drive circuit 23, the scan line drive circuit 24, and the power circuit 25. The timing generation circuit 21 controls the circuits in the drive circuit 20 to operate in conjunction with one another. For example, the timing generation circuit 21 may output a control signal 21A to the above-described respective circuits in response to (in synchronization with) the synchronization signal 20B input from the outside.

For example, the picture signal processing circuit 22 may perform predetermined correction on the digital picture signal 20A input from the outside, and output a picture signal 22A thus obtained to the signal line drive circuit 23. Examples of the predetermined correction may include, for example, gamma correction and overdrive correction.

For example, the signal line drive circuit 23 may apply an analog signal voltage Vsig to the respective signal lines DTL in response to (in synchronization with) the input of the control signal 21A. The analog signal voltage Vsig corresponds to the picture signal 22A input from the picture signal processing circuit 22. For example, the signal line drive circuit 23 is capable of outputting three kinds of voltages (Vofs, Vini, and Vsig). Specifically, the signal line drive circuit 23 supplies the three kinds of voltages (Vofs, Vini, and Vsig) to the pixel 11 that is selected by the scan line drive circuit 24, through the signal line DTL. The signal voltage Vsig has a voltage value corresponding to the picture signal 20A. The fixed voltage Vofs is a constant voltage not relating to the picture signal 20A. A minimum voltage of the signal voltage Vsig is lower than the fixed voltage Vofs, and a maximum voltage of the signal voltage Vsig is higher than the fixed voltage Vofs. The fixed voltage Vini is a constant voltage not relating to the picture signal 20A. The fixed voltage Vini has a voltage value equal to or smaller than (Vofs-Vthr). The threshold voltage Vthr is a threshold voltage of the drive transistor Tr1.

The signal line drive circuit 23 outputs a data pulse P including the signal voltage Vsig to each of the signal lines DTL for each horizontal period. The signal line drive circuit 23 outputs, as the data pulse P, a first pulse P1 and a second pulse P2 alternately with time to each of the signal lines DTL (described later). The first pulse Ps includes two values of the signal voltage Vsig and the fixed voltage Vini, and the second pulse P2 includes two values of the signal voltage Vsig and the fixed voltage Vofs.

The scan line drive circuit 24 sequentially outputs a selection pulse to each of the scan lines WSL during one frame period. For example, the scan line drive circuit 24 may select the plurality of scan lines WSL by a predetermined sequence to perform initialization, Vth correction, writing of the signal voltage Vsig, μ correction, standby, and light emission in a desired order, in response to (in synchronization with) the input of the control signal 21A. In this case, the initialization indicates initialization of the gate voltage of the drive transistor Tr1 (specifically, indicates that the gate voltage of the drive transistor Tr1 is made Vini). The Vth correction indicates correction operation of making the gate-source voltage Vgs of the drive transistor Tr1 close to the threshold voltage of the drive transistor Tr1. The writing of the signal voltage Vsig (the signal writing) indicates operation in which the signal voltage Vsig is written to the gate of the drive transistor Tr1 through the write transistor Tr2. The μ correction indicates operation of correcting the voltage retained between the gate and the source of the drive transistor Tr1 (the gate-source voltage Vgs) based on the magnitude of a mobility μ of the drive transistor Tr1. The signal writing and the μ correction are performed at timings different from each other in some cases. In the present embodiment, the scan line drive circuit 24 outputs one selection pulse to the scan line WSL to perform the signal writing and the μ correction at the same time (or successively with no pause). The standby indicates standby in a state where light emission is allowed to be started (namely, maintaining a light extinction state).

For example, the scan line drive circuit 24 is capable of outputting two kinds of voltages (Von and Voff). Specifically, the scan line drive circuit 24 supplies the two kinds of voltages (Von and Voff) to the pixel 11 to be driven, through the scan line WSL, to perform on-off control of the write transistor Tr2. Here, the voltage Von has a value equal to or larger than an on voltage of the write transistor Tr2. The voltage Von is equivalent to a crest value of a write pulse that is output from the scan line drive circuit 24 during an "initialization period", a "Vth correction period", a "signal writing-μ correction period", and the like that will be described later. The voltage Voff has a value lower than the on voltage of the write transistor Tr2, and is lower than the voltage Von. The voltage Voff is equivalent to a crest value of the write pulse output from the scan line drive circuit 24 during a "Vth correction preparation period", a "Vth correction suspension period", a "standby period", a "light emission period", and the like that will be described later.

The power circuit 25 outputs a constant voltage to each of the power lines DSL, and specifically, continuously outputs the constant voltage (a voltage Vcc) to each of the power lines DSL during one frame period. In this case, the voltage Vcc has a voltage value equal to or larger than a voltage (Ve1+Vcath) that is a sum of a threshold voltage Ve1 of the organic EL element 13 and a cathode voltage Vcath of the organic EL element 13.

(Operation)

Next, the operation (the operation from light extinction to light emission) of the display unit 1 according to the present embodiment is described with reference to FIG. 3 to FIG. 8. In the present embodiment, compensating operation to variation of I-V characteristics of the organic EL element 13 is incorporated in order to maintain constant light emission luminance of the organic EL element 13 without being affected from temporal change of the I-V characteristics of the organic EL element 13 even if such temporal change occurs. Further, in the present embodiment, compensating operation to variation of the threshold voltage and the mobility is incorporated in order to maintain constant light emission luminance of the organic EL element 13 without being affected from the temporal change of the threshold voltage and the mobility of the drive transistor Tr1 even if such temporal change occurs.

Figure 3:
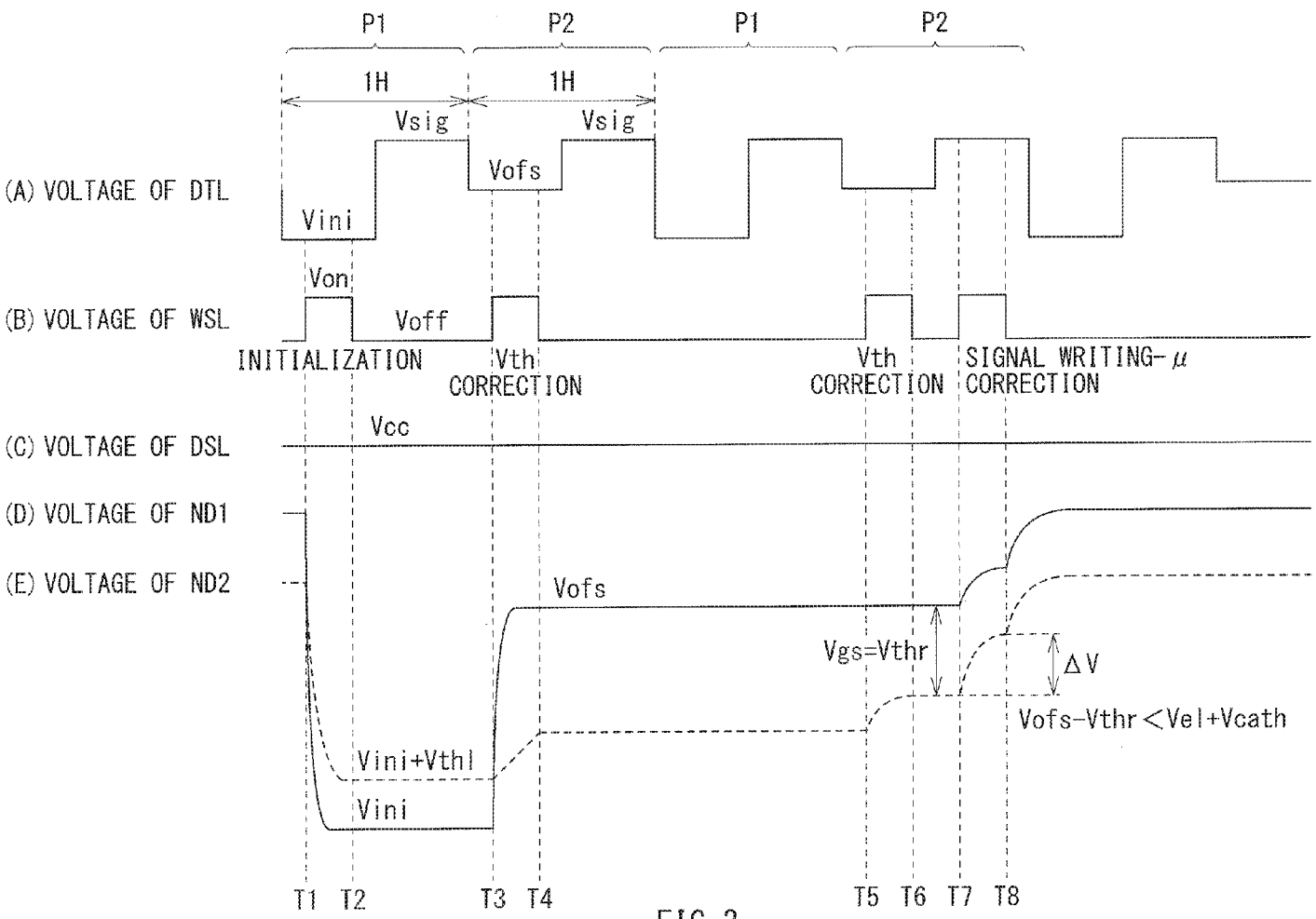
Figure 4:
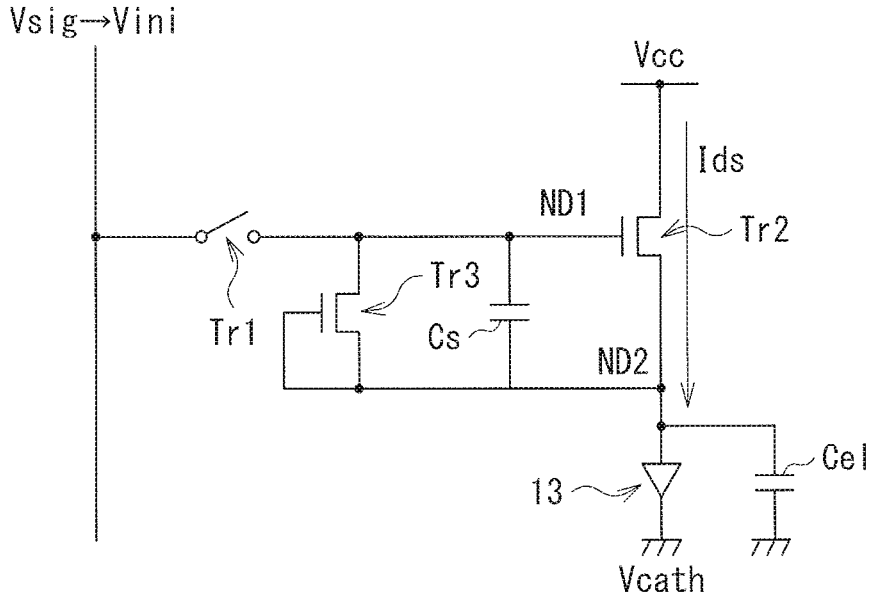
FIG. 4 is a diagram illustrating an example of operation of a pixel during a period from light extinction to light emission.
Figure 5:
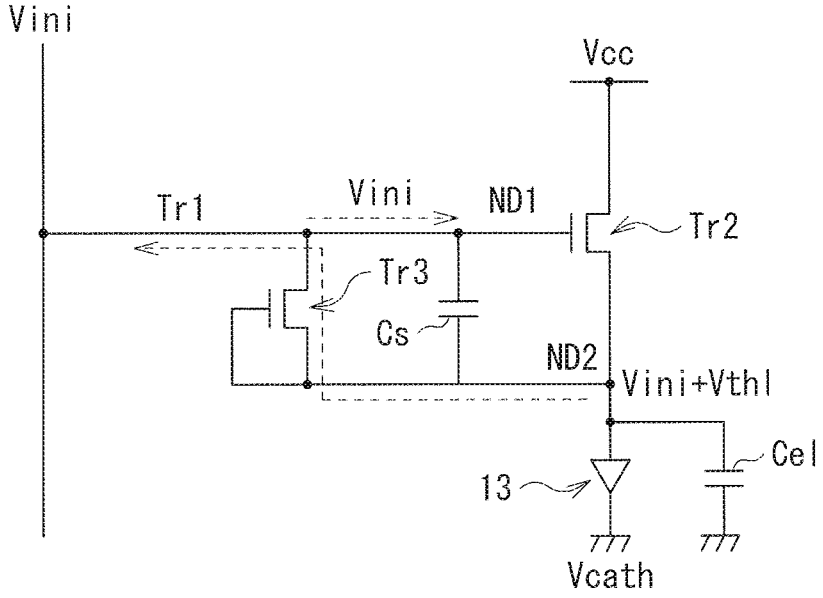
FIG. 5 is a diagram illustrating an example of operation following the operation of FIG. 4.
Figure 6:
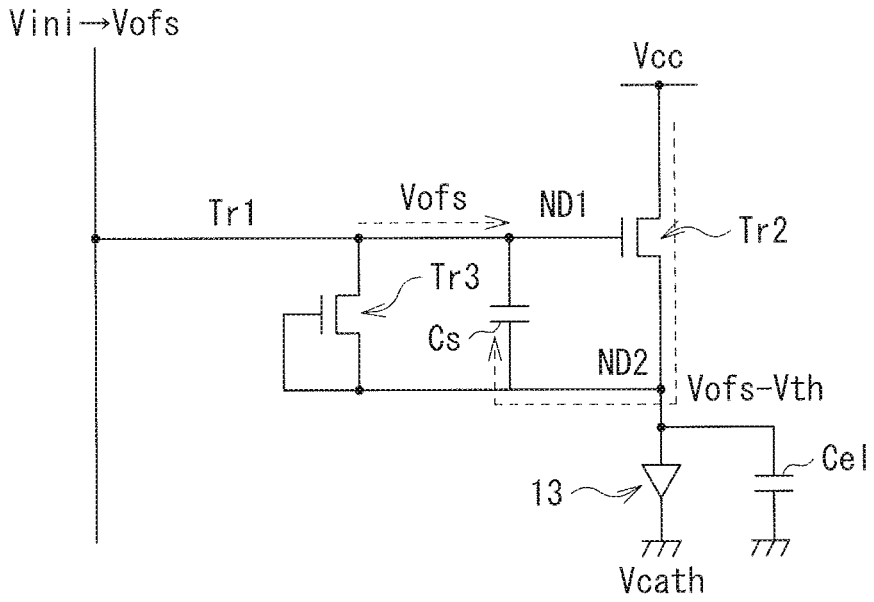
FIG. 6 is a diagram illustrating an example of operation following the operation of FIG. 5.
Figure 7:
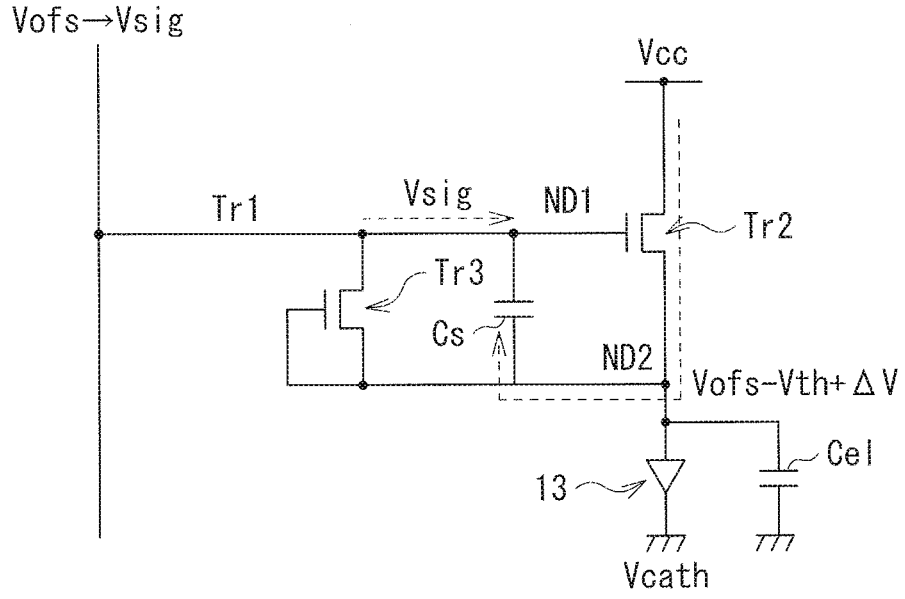
FIG. 7 is a diagram illustrating an example of operation following the operation of FIG. 6.

FIG. 3 illustrates an example of temporal change of the voltages applied to the signal line DTL, the scan line WSL, and the power line DSL and the voltages of the nodes ND1 and ND2 when one pixel 11 is focused on. Note that the voltage of the node ND1 is the gate voltage of the drive transistor Tr1. The voltage of the node ND2 is the source voltage of the drive transistor Tr1. FIG. 4 to FIG. 8 each illustrate an example of the operation of the pixel 11 during a period from light extinction to light emission.

(Initialization Period)

First, the drive circuit 20 initializes the gate voltage of the drive transistor Tr1. Specifically, when the voltage of the scan line WSL is Voff, the voltage of the signal line DTL is Vini, and the voltage of the power line DSL is Vcc (FIG. 4), the scan line drive circuit 24 raises the voltage of the scan line WSL from Voff to Von in response to the control signal 21A (at a time T1, FIG. 5). In other words, the scan line drive circuit 24 raises the voltage of the scan line WSL from Voff to Von in response to the control signal 21A when the organic EL element 13 emits light. Then, the cutoff transistor Tr3 is turned on, and the voltage of the node ND2 is discharged. On the other hand, the node ND1 is supplied with the fixed voltage Vini, and thus the drive transistor Tr2 is turned off. The supply of the current Ids to the organic EL element 13 is stopped in response to turned-off of the drive transistor Tr2, and thus the organic EL element 13 is put into a non-light emission state.

After that, the potential of the node ND2 continuously drops until the cutoff transistor Tr3 is turned off. When the potential of the node ND2 becomes Vini+Vth1, the cutoff transistor Tr3 is turned off and the voltage drop is stopped. Vth1 indicates a threshold voltage of the cutoff transistor Tr3. Here, the gate-source voltage Vgs of the drive transistor Tr1 is −Vth1 (=Vini−(Vini+Vth1)). Specifically, the gate-source voltage Vgs of the drive transistor Tr1 becomes smaller than the threshold voltage Vthr of the drive transistor Tr1, and becomes a cutoff operation point. In other words, even if the drain voltage of the drive transistor Tr1 is the voltage Vcc that allows the organic EL element 13 to emit light, the current does not flow through the drive transistor Tr1, and the gate voltage of the drive transistor Tr1 is initialized. As a result, the voltage of the first node ND1 becomes Vini.

(Vth Correction Preparation)

Next, the drive circuit 20 performs preparation of the Vth correction that makes the gate-source voltage Vgs of the drive transistor Tr1 close to the threshold voltage of the drive transistor Tr1. Specifically, the drive circuit 20 lowers the voltage of the scan line WSL from Von to Voff in response to the control signal 21A (at a time T2), then switches the voltage of the signal line DTL from Vini to Vsig and then from Vsig to Vofs in response to the control signal 21A.

(Vth Correction Period)

Next, the drive circuit 20 performs the Vth correction. Specifically, while the voltage of the signal line DTL is Vofs and the voltage of the power line DSL is Vcc, the scan line drive circuit 24 raises the voltage of the scan line WSL from Voff to Von in response to the control signal 21A (at a time T3, FIG. 6). Then, the gate-source voltage Vgs of the drive transistor Tr1 becomes larger than the threshold voltage Vthr once. As a result, the drive transistor Tr1 is turned on, and the current starts to flow through the drive transistor Tr1. At this time, when the Vth correction is not completed, the current Ids flows between the drain and the source of the drive transistor Tr1 until the gate-source voltage Vgs becomes Vthr. Accordingly, the voltage of the node ND1 becomes Vofs and the voltage of the node ND2 rises, and as a result, the retention capacitance Cs is charged to a voltage close to Vthr and the gate-source voltage Vgs approaches Vthr.

(Vth Correction Suspension Period)

Next, the drive circuit 20 suspends the Vth correction until the subsequent Vth correction period. Specifically, the drive circuit 20 lowers the voltage of the scan line WSL from Von to Voff in response to the control signal 21A (at a time T4).

(Vth Correction Period)

Next, the drive circuit 20 performs the Vth correction again. Note that the drive circuit 20 may omit the Vth correction this time as necessary. Specifically, while the voltage of the signal line DTL is Vofs and the voltage of the power line DSL is Vcc, the scan line drive circuit 24 raises the voltage of the scan line WSL from Voff to Von in response to the control signal 21A (at a time T5, FIG. 6). Then, the drive transistor Tr1 is turned on again, and the current starts to flow through the drive transistor Tr1. After that, the voltage of the node ND2 rises, the retention capacitance Cs is charged to Vthr, and the gate-source voltage Vgs becomes Vthr. As a result, the Vth correction is completed. After that, the drive circuit 20 lowers the voltage of the scan line WSL from Von to Voff in response to the control signal 21A (at a time T6).

(Signal Writing-μ Correction Period)

Next, the drive circuit 20 performs writing of the signal voltage based on the picture signal 20A, and performs the μ correction. Specifically, first, the drive circuit 20 changes the voltage of the signal line DTL from Vofs to Vsig. Subsequently, the drive circuit 20 raises the voltage of the scan line WSL from Voff to Von in response to the control signal 21A (at a time T7, FIG. 7) while the voltage of the power line DSL is Vcc. Then, the gate of the drive transistor Tr1 is connected to the signal line DTL, and the voltage of the node ND1 becomes the voltage Vsig of the signal line DTL. At this time, the voltage of the node ND2 is still lower than the threshold voltage Ve1 of the organic EL element 13 at this stage, and the organic EL element 13 is cut off. Therefore, the current Ids flows through the element capacitance Ce1 of the organic EL element 13, and the element capacitance Ce1 is charged. As a result, the voltage of the node ND2 rises by ΔV, and the gate-source voltage Vgs eventually becomes Vsig+Vthr−ΔV. In this way, the μ correction is performed at the same time as the writing. Here, ΔV becomes larger as the mobility μ of the drive transistor Tr1 is larger. Therefore, variation of the mobility μ for each pixel 11 is allowed to be eliminated by making the gate-source voltage Vgs small by ΔV before light emission.

(Light Emission Period)

Figure 8:
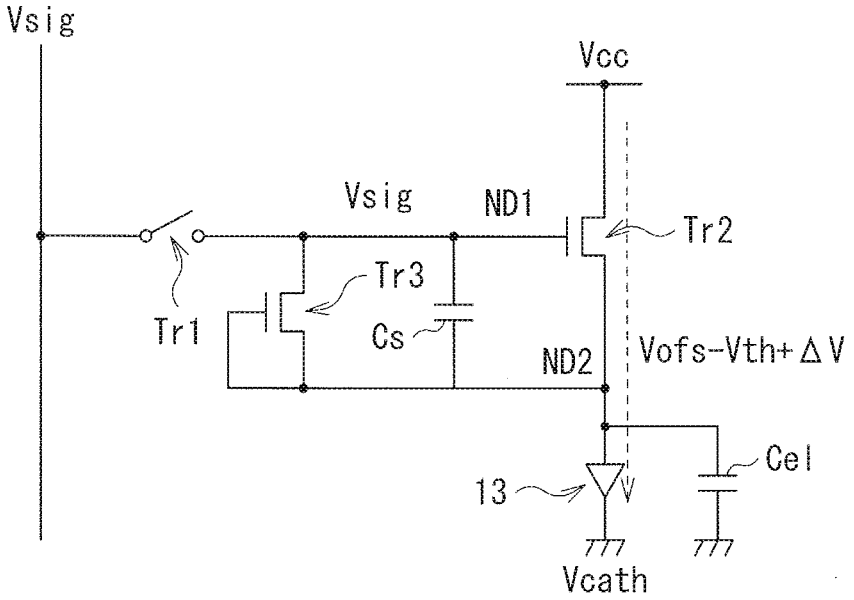
FIG. 8 is a diagram illustrating an example of operation following the operation of FIG. 7.

Finally, the drive circuit 20 lowers the voltage of the scan line WSL from Von to Voff in response to the control signal 21A (at a time T8, FIG. 8). Then, the current Ids flows between the drain and the source of the drive transistor Tr1, which raises the source voltage Vs. As a result, the voltage equal to or larger than the threshold voltage Ve1 is applied to the organic EL element 13, and thus the organic EL element 13 emits light at a desired luminance.

Figure 9:
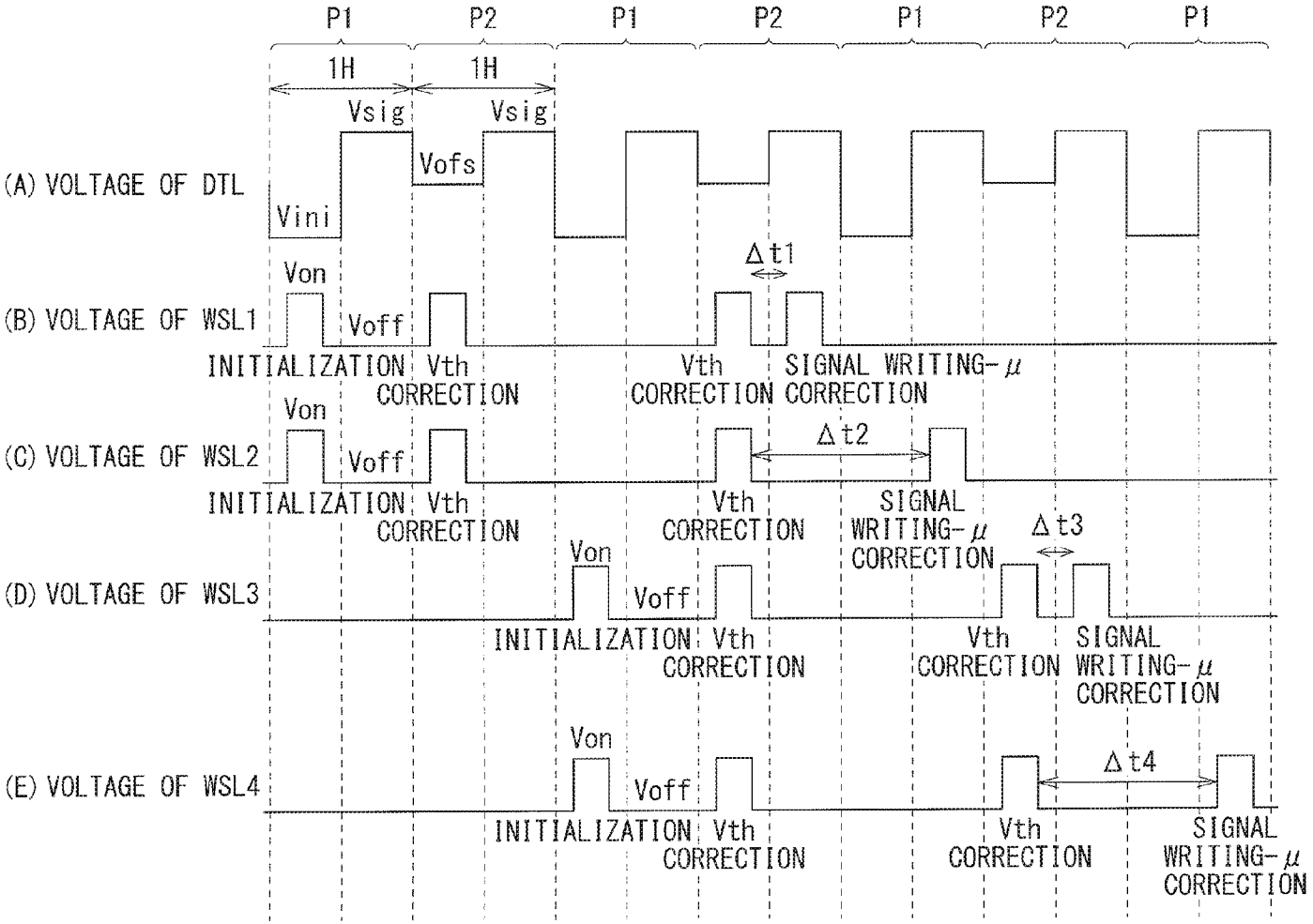
FIG. 9 is a waveform diagram illustrating an example of temporal change of voltages applied to the signal line DTL and scan lines WSL1 to WSL4 during a first frame period.
Figure 10:
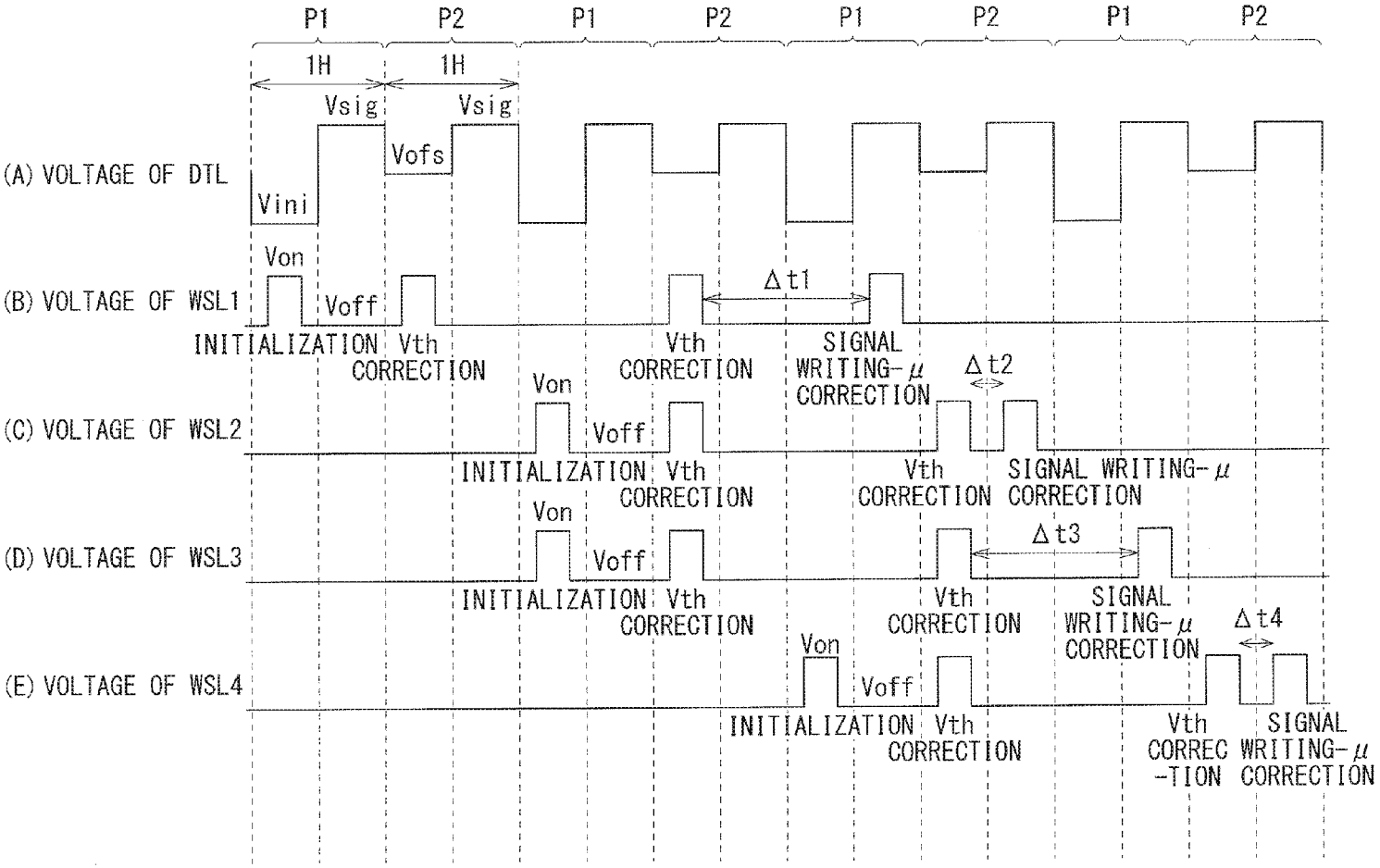
FIG. 10 is a waveform diagram illustrating an example of temporal change of voltages applied to the signal line DTL and the scan lines WSL1 to WSL4 during a second frame period.

FIG. 9 illustrates an example of temporal change of the voltages applied to the signal line DTL and the scan lines WSL1 to WSL4 during a first frame period. FIG. 10 illustrates an example of temporal change of the voltages applied to the signal line DTL and the scan lines WSL1 to WSL4 during a second frame period subsequent to the first frame period.

In the present embodiment, as described above, the signal line drive circuit 23 outputs, as the data pulse P, the first pulse P1 and the second pulse P2 alternately with time to each of the signal lines DTL. At this time, the scan line drive circuit 24 outputs a selection pulse for initialization, a selection pulse for Vth correction, or a selection pulse for signal writing, depending on the voltage value of the data pulse P output to each of the signal lines DTL. To initialize the gate voltage of the drive transistor Tr1, the scan line drive circuit 24 outputs the selection pulse to each of the scan lines WSL when the fixed voltage Vini is applied to each of the signal lines DTL. To perform the Vth correction to make the gate-source voltage Vgs of the drive transistor Tr1 close to the threshold voltage of the drive transistor Tr1, the scan line drive circuit 24 outputs the selection pulse to each of the scan lines WSL when the fixed voltage Vofs is applied to each of the signal lines DTL. To write the signal voltage Vsig to the gate of the drive transistor Tr1, the scan line drive circuit 24 outputs the selection pulse to each of the scan lines WSL when the signal voltage Vsig is applied to each of the signal lines DTL.

For example, the scan lien drive circuit 24 may output the selection pulse for initialization and the selection pulse for Vthe correction to n-th pixel row (n-th horizontal period) and n+1-th pixel row (n+1-th horizontal period) at a time during the first frame period. Subsequently, for example, the scan line drive circuit 24 may output the selection pulse for signal writing in first to the n-th pixel row, and output the selection pulse for signal writing to the n+1-th pixel row 1H behind. At this time, an interval Δt1 between the selection pulse for Vth correction and the selection pulse for signal writing in the n-th pixel row is shorter than an interval Δt2 between the selection pulse for Vth correction and the selection pulse for signal writing in the n+1-th pixel row.

Further, for example, the scan line drive circuit 24 may output the selection pulse for initialization and the selection pulse for Vth correction to the n+1-th pixel row and n+2-th pixel row at a time during the second frame period subsequent to the first period. Subsequently, for example, the scan line drive circuit 24 may output the selection pulse for signal writing in first to the n+1-th pixel row, and output the selection pulse for signal writing to the n+2-th pixel row 1H behind. At this time, the interval Δt2 between the selection pulse for Vth correction and the selection pulse for signal writing in the n+1-th pixel row is shorter than an interval Δt3 between the selection pulse for Vth correction and the selection pulse for signal writing in the n+2-th pixel row. Moreover, the interval Δt1 between the selection pulse for Vth correction and the selection pulse for signal writing in the n-th pixel row is longer than the interval Δt2 between the selection pulse for Vth correction and the selection pulse for signal writing in the n+1-th pixel row.

As described above, for example, during the first frame period, the scan line drive circuit 24 may output the selection pulse to each of the scan lines WSL so that the interval Δt1 in the n-th horizontal period is shorter than the interval Δt2 in the n+1-th horizontal period. Further, for example, during the second frame period, the scan line drive circuit 24 may output the selection pulse to each of the scan lines WSL so that the interval Δt1 in the n-th horizontal period is longer than the interval Δt2 in the n+1-th horizontal period. When the scan line drive circuit 24 performs such scanning, the interval between the selection pulse for Vth correction and the selection pulse for signal writing in a certain pixel row may become short or long for every single frame or every plurality of frames.

Here, standby of the light emission operation is performed in a state where the gate-source voltage Vgs is kept constant (Vthr), during a period between the selection pulse for Vth correction and the selection pulse for signal writing. During the standby of the light emission operation, in the case where the current leakage slightly occurs in the drive transistor Tr1, the gate-source voltage Vgs may be slightly varied. If the gate-source voltage Vgs is varied even slightly, the light emission luminance is varied. Therefore, if the interval between the selection pulse for Vth correction and the selection pulse for signal writing is varied for each pixel row, stripe may occur in a display picture.

However, as described above, the interval between the selection pulse for Vth correction and the selection pulse for signal writing is made short or long for every single frame or every plurality of frames in a certain pixel row, which suppresses occurrence of stripe in the display picture.

(Effects)

Next, effects in the display unit 1 according to the present embodiment will be described.

Typically, in the active matrix organic EL display unit, a large current is allowed to flow through the power lines in order to supply power from the power lines to respective pixels. However, pulse power controlling light emission and light extinction of the organic EL element is normally applied to the power lines. Therefore, the scale of the power line drive circuit becomes extremely large, and the bezel of the display panel including the power line drive circuit therein becomes large as well. Therefore, for example, it is considered that the voltage of the power lines is fixed and the data pulse applied to the signal lines is formed of a waveform having three values in 1H. In such a case, however, a timing margin may be lacked and uniformity may be impaired due to wiring transient because the time period of 1H is gradually decreased in association with increase in resolution recently.

On the other hand, in the present embodiment, the data pulse P output to each of the signal lines DTL for each horizontal period is formed of the signal voltage Vsig based on the picture signal and one of the fixed voltage Vini and the fixed voltage Vofs. Therefore, as compared with the case where the data pulse P is formed of the signal voltage, the fixed voltage Vini, and the fixed voltage Vofs, a period during which each voltage is output to each of the signal lines DTL is allowed to be increased. As a result, when the voltage of the power lines DL is fixed, it is possible to reduce possibility that the timing margin is lacked. Accordingly, it is possible to suppress impairing of the uniformity in association with reduction in the size of the bezel.

Moreover, in the present embodiment, when the interval between the selection pulse for Vth correction and the selection pulse for signal writing is made short or long for every single frame or every plurality of frames in a certain pixel row, it is possible to suppress occurrence of stripe in a display picture. Therefore, also in this case, it is possible to reduce impairing of uniformity in association with reduction in the size of the bezel.

<2. Modification>

A modification of the display unit 1 according to the above-described embodiment will be described below. Note that like numerals are used to designate components common to those in the display unit 1 according to the above-described embodiment. Further, description for the components common to those in the display unit 1 according to the above-described embodiment will be appropriately omitted.

Figure 11:
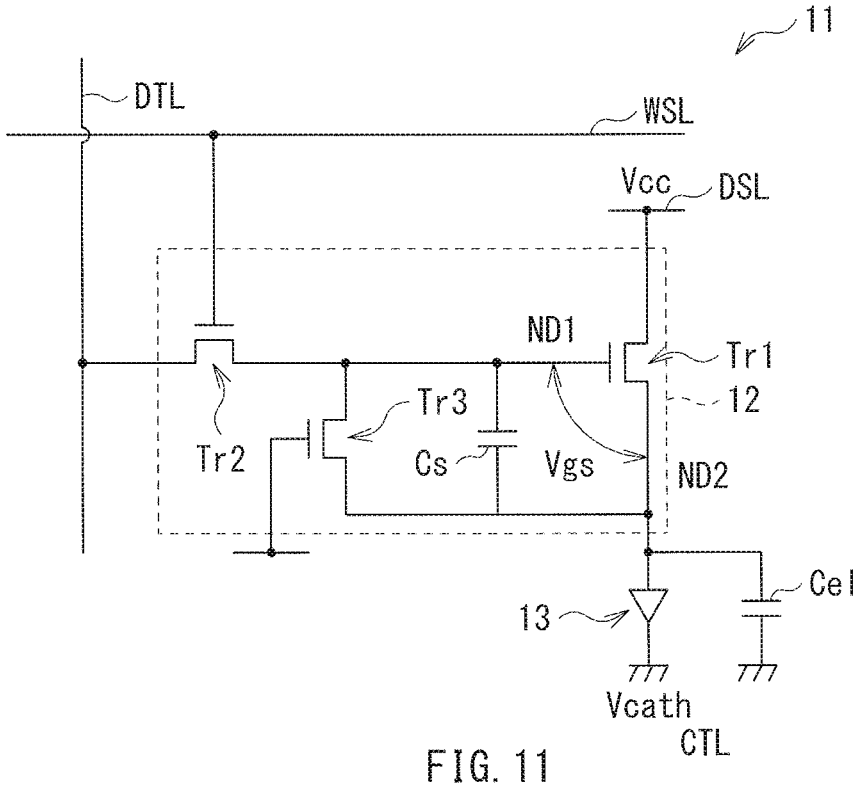
FIG. 11 is a diagram illustrating a modification of a pixel circuit.

In the above-described embodiment, the cutoff transistor Tr3 is diode-connected. However, for example, as illustrated in FIG. 11, the gate of the cutoff transistor Tr3 may be set to a fixed voltage. Incidentally, such a fixed voltage has a value allowing the cutoff transistor Tr3 to be turned on only in the initialization. In the present modification, effects similar to those in the above-described embodiment are obtainable. Moreover, in the present modification, a depression transistor is allowed to be suitably used as the cutoff transistor Tr3.

<3. Application Examples>

Hereinafter, application examples of the display unit 1 that is described in the above-described embodiment and the modification thereof (hereinafter, referred to as "the above-described embodiment and the like") will be described. The display unit 1 according to the above-described embodiment and the like is applicable to a display unit of electronic apparatuses in every field that displays a picture signal externally input or a picture signal internally generated as an image or a picture, such as a television apparatus, a digital camera, a notebook personal computer, a mobile terminal device such as a mobile phone, and a video camera.

Application Example 1

Figure 12:
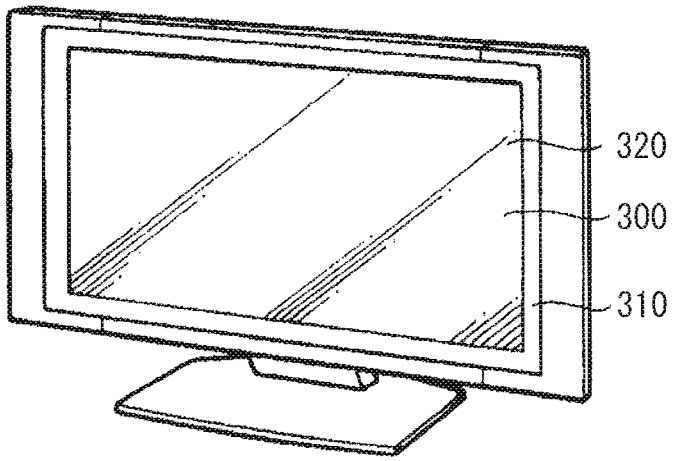
FIG. 12 is a perspective view illustrating an appearance of an application example 1 of the display unit according to the above-described embodiment.

FIG. 12 illustrates an appearance of a television apparatus to which the display unit 1 according to the above-described embodiment and the like is applied. For example, the television apparatus may have a picture display screen section 300 that includes a front panel 310 and a filter glass 320, and the picture display screen section 300 is configured of the display unit 1 according to the above-described embodiment and the modification thereof.

Application Example 2

Figure 13A:
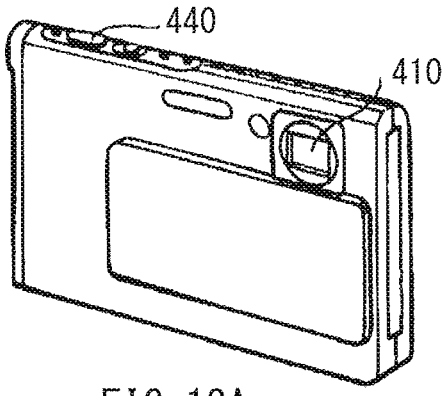
FIG. 13A is a perspective view illustrating an appearance of an application example 2 as viewed from a front side thereof.
Figure 13B:
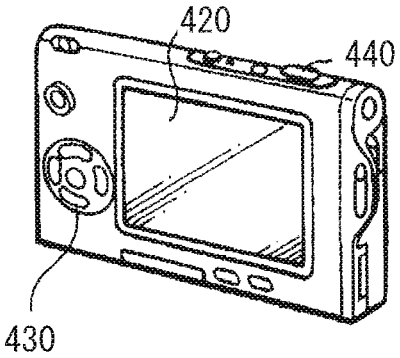
FIG. 13B is a perspective view illustrating the appearance of the application example 2 as viewed from a back side thereof.

FIG. 13A and FIG. 13B each illustrate an appearance of a digital camera to which the display unit 1 according to the above-described embodiment and the like is applied. For example, the digital camera may include a light emitting section 410 for flash, a display section 420, a menu switch 430, and a shutter button 440. The display section 420 is configured of the display unit 1 according to the above-described embodiment and the like.

Application Example 3

Figure 14:
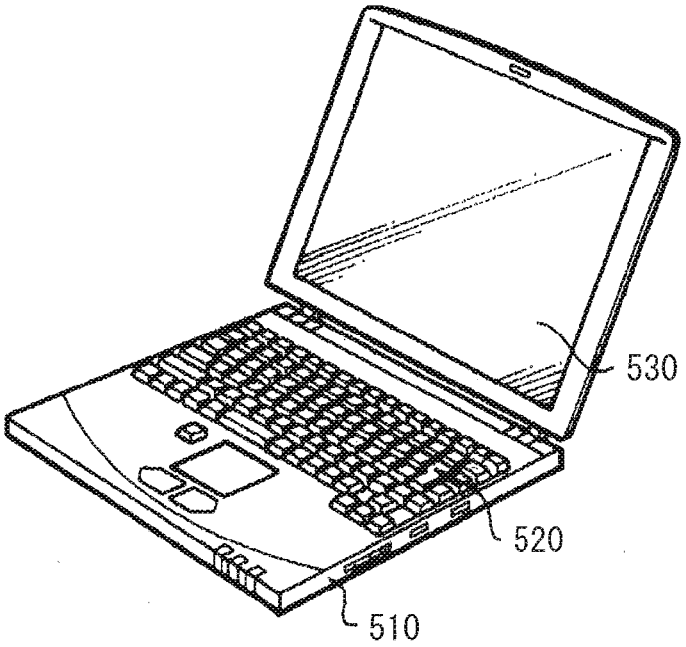
FIG. 14 is a perspective view illustrating an appearance of an application example 3 as viewed from a back side thereof.

FIG. 14 illustrates an appearance of a notebook personal computer to which the display unit 1 according to the above-described embodiment and the like is applied. For example, the notebook personal computer may have a main body 510, a keyboard 520 for input operation of characters and the like, and a display section 530 configured to display an image. The display section 530 is configured of the display unit 1 according to the above-described embodiment and the like.

Application Example 4

Figure 15:
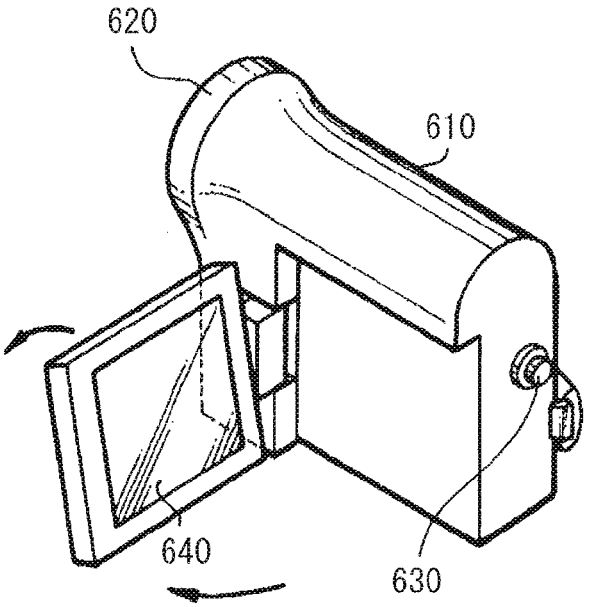
FIG. 15 is a perspective view illustrating an appearance of an application example 4.

FIG. 15 illustrates an appearance of a video camera to which the display unit 1 according to the above-described embodiment and the like is applied. For example, the video camera may include a main body section 610, a lens 620 that is provided on a front side surface of the main body section 610 and is used to shoot an object, a shooting start-stop switch 630, and a display section 640. The display section 640 is configured of the display unit 1 according to the above-described embodiment and the like.

Application Example 5

Figure 16A:
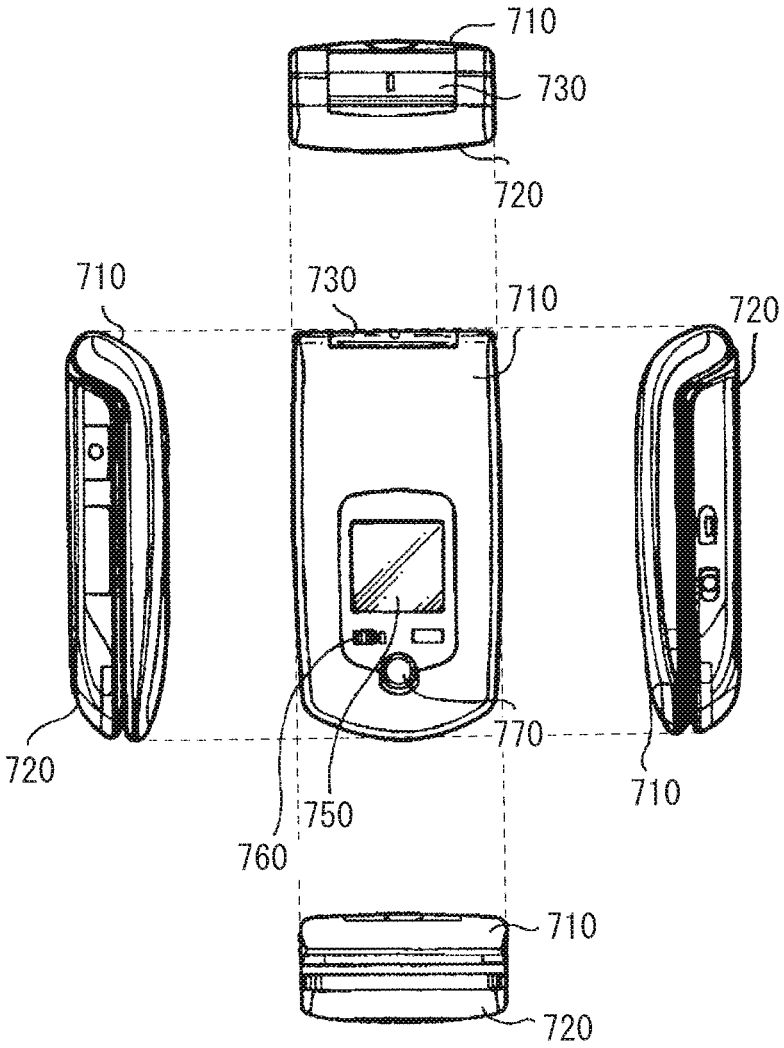
FIG. 16A is a front view, a left-side view, a right-side view, a top view, and a bottom view of an application example 5 in a closed state.
Figure 16B:
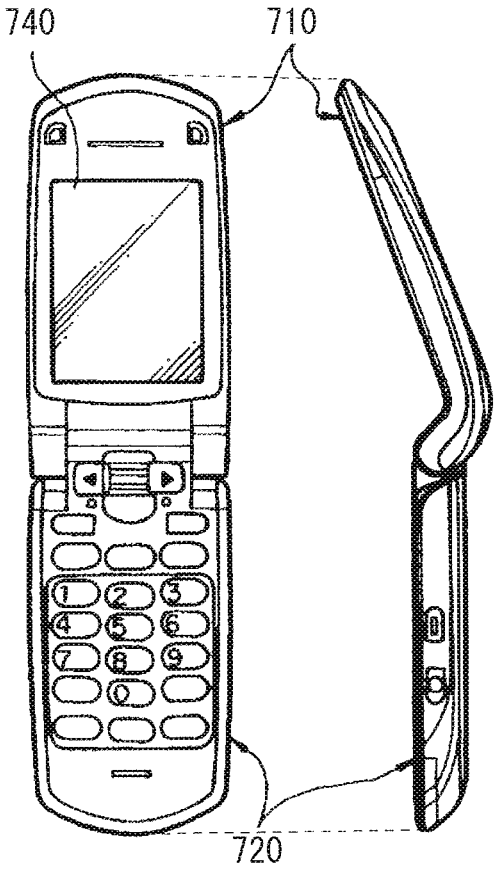
FIG. 16B is a front view and a side view of the application example 5 in an open state.
Figure 17:
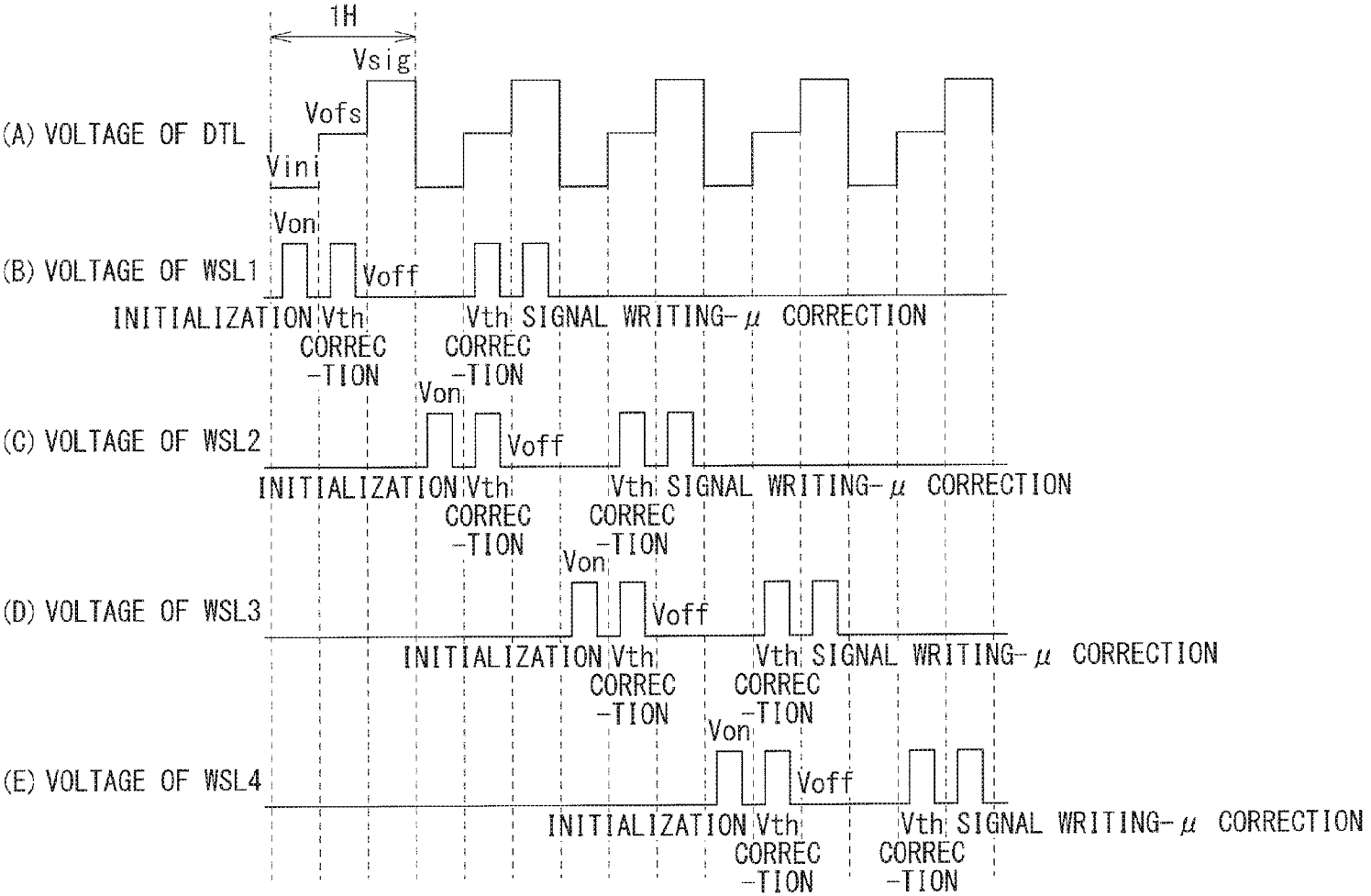
FIG. 17 is a waveform diagram illustrating an example of temporal change of voltages applied to a signal line DTL and scan lines WSL1 to SWL4 according to a comparative example.

FIG. 16A and FIG. 16B each illustrate an appearance of a mobile phone to which the display unit 1 according to the above-described embodiment and the like is applied. For example, the mobile phone may be configured by connecting an upper housing 710 and a lower housing 720 with a connection section (a hinge section) 730, and may include a display 740, a sub-display 750, a picture light 760, and a camera 770. The display 740 or the sub-display 750 is configured of the display unit 1 according to the above-described embodiment and the like.

Hereinbefore, although the technology has been described with referring to the embodiment and the application examples, the technology is not limited to the above-described embodiment and the like, and various modifications may be made.

For example, the configuration of the pixel circuit 12 for the active matrix driving is not limited to that described in the above-described embodiment, and a capacitor and a transistor may be added as necessary. In this case, necessary drive circuits may be added based on modification of the pixel circuit 12, in addition to the signal line drive circuit 23, the scan line drive circuit 24, the power circuit 25, and the like described above.

Moreover, in the above-described embodiment and the like, the driving of the signal line drive circuit 23, the scan line drive circuit 24, and the power circuit 25 are controlled by the timing generation circuit 21 and the picture signal processing circuit 22. However, other circuits may control the driving. Moreover, the control of the signal line drive circuit 23, the scan line drive circuit 24, and the power circuit 25 may be performed by hardware (circuits) or software (programs).

Furthermore, in the above-described embodiment and the like, the source and the drain of the write transistor Tr2, the source and the drain of the drive transistor Tr1, and the source and the drain of the cutoff transistor Tr3 are assumed to be fixed in the description. However, opposed relation between the source and the drain is inverted from the above-described description depending on the flowing direction of the current. In such a case, the source may be read as the drain and the drain may be read as the source in the above-described embodiment and the like.

Moreover, in the above-described embodiment and the like, each of the write transistor Tr2, the drive transistor Tr1, and the cutoff transistor Tr3 is assumed to be formed of an n-channel MOS TFT in the description. However, one or more of these transistors may be formed of a p-channel MOS TFT. Incidentally, in the case where the drive transistor Tr1 is formed of a p-channel MOS TFT, the anode of the organic EL element 13 becomes the cathode and the cathode of the organic EL element 13 becomes the anode in the above-described embodiment and the like. Moreover, in the above-described embodiment and the like, each of the write transistor Tr2, the drive transistor Tr1, and the cutoff transistor Tr3 is not necessarily an amorphous silicon TFT or a micro silicon TFT, and for example, may be a low-temperature polysilicon TFT or an oxide semiconductor TFT.

Moreover, for example, the present technology may be configured as follows.

(1) A display unit including:

a display panel; and a drive circuit configured to drive the display panel, wherein the display panel includes a plurality of pixels arranged in a matrix, signal lines configured to supply a data pulse to the respective pixels, scan lines configured to supply a selection pulse to the respective pixels, the selection pulse selecting the respective pixels for each row, and power lines configured to supply power to the respective pixels, the drive circuit includes a signal line drive circuit configured to output the data pulse to each of the signal lines for each horizontal period, a scan line drive circuit configured to sequentially output the selection pulse to each of the scan lines during one frame period, and a power circuit configured to continuously output a constant voltage to the power lines during one frame period, and the data pulse is formed of a signal voltage and one of a first fixed voltage and a second fixed voltage, the signal voltage based on a picture signal, and the first fixed voltage being smaller than the second fixed voltage.

(2) The display unit according to (1), wherein each of the pixels includes a light emitting element and a pixel circuit configured to drive the light emitting element, and the pixel circuit includes a first transistor having a gate, a source, and a drain, and configured to sample a voltage applied to the signal line, the gate being connected to the scan line, and one of the source and the drain being connected to the signal line, a second transistor having a gate, a source, and a drain, and configured to control a current flowing through the light emitting element based on magnitude of the voltage sampled by the first transistor, one of the source and the drain being connected to the power line, a retention capacitance configured to retain the voltage sampled by the first transistor, and a third transistor connected in parallel to the retention capacitance.

(3) The display unit according to (2), wherein the scan line drive circuit outputs the selection pulse to each of the scan lines to write the signal voltage to the gate of the second transistor when the signal voltage is applied to each of the signal lines, outputs the selection pulse to each of the scan lines to initialize the gate voltage of the second transistor when the first fixed voltage is applied to each of the signal lines, and outputs the selection pulse to each of the scan lines to perform correction when the second fixed voltage is applied to each of the signal lines, the correction making a gate-source voltage of the second transistor close to a threshold voltage of the second transistor.

(4) The display unit according to (2) or (3), wherein the signal line drive circuit outputs, as the data pulse, a first pulse and a second pulse alternately with time to each of the signal lines, the first pulse being formed of two values of the signal voltage and the first fixed voltage, and the second pulse being formed of two values of the signal voltage and the second fixed voltage.

(5) The display unit according to (4), wherein a first selection pulse indicates the selection pulse applied to each of the scan lines when the second fixed voltage is applied to each of the signal lines, a second selection pulse indicates the selection pulse applied to each of the scan lines when the signal voltage is applied to each of the signal lines, the scan line drive circuit outputs the selection pulse to each of the scan lines to allow an interval between the first selection pulse and the second selection pulse in n-th horizontal period to be shorter than an interval between the first selection pulse and the second selection pulse in n+1-th horizontal period, during a first frame period, and the scan line drive circuit outputs the first selection pulse and the second selection pulse to each of the scan lines to allow the interval between the first selection pulse and the second selection pulse in the n-th horizontal period to be longer than the interval between the first selection pulse and the second selection pulse in the n+1-th horizontal period, during a second frame period subsequent to the first frame period.

(6) An electronic apparatus provided with a display unit, the display unit including:

a display panel; and a drive circuit configured to drive the display panel, wherein the display panel includes a plurality of pixels arranged in a matrix, signal lines configured to supply a data pulse to the respective pixels, scan lines configured to supply a selection pulse to the respective pixels, the selection pulse selecting the respective pixels for each row, and power lines configured to supply power to the respective pixels, the drive circuit includes a signal line drive circuit configured to output the data pulse to each of the signal lines for each horizontal period, a scan line drive circuit configured to sequentially output the selection pulse to each of the scan lines during one frame period, and a power circuit configured to continuously output a constant voltage to the power lines during one frame period, and the data pulse is formed of a signal voltage and one of a first fixed voltage and a second fixed voltage, the signal voltage based on a picture signal, and the first fixed voltage being smaller than the second fixed voltage.

(7) A drive circuit configured to drive a display panel, the display panel including a plurality of pixels arranged in a matrix, signal lines configured to supply a data pulse to the respective pixels, scan lines configured to supply a selection pulse to the respective pixels, the selection pulse selecting the respective pixels for each row, and power lines configured to supply power to the respective pixels, the drive circuit including:

a signal line drive circuit configured to output the data pulse to each of the signal lines for each horizontal period;

a scan line drive circuit configured to sequentially output the selection pulse to each of the scan lines during one frame period; and a power circuit configured to continuously output a constant voltage to the power lines during one frame period, wherein the data pulse is formed of a signal voltage and one of a first fixed voltage and a second fixed voltage, the signal voltage based on a picture signal, and the first fixed voltage being smaller than the second fixed voltage.

It should be understood by those skilled in the art that various modifications, combinations, sub-combinations, and alterations may occur depending on design requirements and other factors insofar as they are within the scope of the appended claims or the equivalents thereof.

What is claimed is:

1. A display unit comprising:

a display panel; and a drive circuit configured to drive the display panel, wherein the display panel includes a plurality of pixels arranged in a matrix;

signal lines configured to supply a first data pulse and a second data pulse to the respective pixels, the first data pulse being formed of two values of a signal voltage and a first fixed voltage, the second data pulse being formed of two values of the signal voltage and a second fixed voltage, the first fixed voltage being smaller than the second fixed voltage, scan lines configured to supply a selection pulse to the respective pixels, the selection pulse selecting the respective pixels for each row, and power lines configured to supply power to the respective pixels, the drive circuit includes a signal line drive circuit configured to output the first data pulse and the second data pulse alternately to each of the signal lines for each horizontal period, a scan line drive circuit configured to sequentially output the selection pulse to each of the scan lines during one frame period, and a power circuit configured to continuously output a constant voltage to the power lines during the one frame period.

2. The display unit according to claim 1, wherein each of the pixels includes a light emitting element and a pixel circuit configured to drive the light emitting element, and the pixel circuit includes a first transistor having a gate, a source, and a drain, and configured to sample a voltage applied to the signal line, the gate being connected to the scan line, and one of the source and the drain being connected to the signal line, a second transistor having a gate, a source, and a drain, and configured to control a current flowing through the light emitting element based on magnitude of the voltage sampled by the first transistor, one of the source and the drain being connected to the power line, a retention capacitance configured to retain the voltage sampled by the first transistor, and a third transistor connected in parallel to the retention capacitance.

3. The display unit according to claim 2, wherein the scan line drive circuit outputs the selection pulse to each of the scan lines to write the signal voltage to the gate of the second transistor when the signal voltage is applied to each of the signal lines, outputs the selection pulse to each of the scan lines to initialize the gate voltage of the second transistor when the first fixed voltage is applied to each of the signal lines, and outputs the selection pulse to each of the scan lines to perform correction when the second fixed voltage is applied to each of the signal lines, the correction making a gate-source voltage of the second transistor close to a threshold voltage of the second transistor.

4. The display unit according to claim 2, wherein the signal line drive circuit outputs the first data pulse and the second data pulse alternately with time within each of the horizontal periods to each of the signal lines.

5. The display unit according to claim 4, wherein a first selection pulse indicates the selection pulse applied to each of the scan lines when the second fixed voltage is applied to each of the signal lines, a second selection pulse indicates the selection pulse applied to each of the scan lines when the signal voltage is applied to each of the signal lines, the scan line drive circuit outputs the selection pulse to each of the scan lines to allow an interval between the first selection pulse and the second selection pulse in an n-th horizontal period to be shorter than an interval between the first selection pulse and the second selection pulse in an n+1-th horizontal period, during a first frame period, and the scan line drive circuit outputs the first selection pulse and the second selection pulse to each of the scan lines to allow the interval between the first selection pulse and the second selection pulse in the n-th horizontal period to be longer than the interval between the first selection pulse and the second selection pulse in the n+1-th horizontal period, during a second frame period subsequent to the first frame period.

6. An electronic apparatus provided with a display unit, the display unit comprising:

a display panel; and a drive circuit configured to drive the display panel, wherein the display panel includes a plurality of pixels arranged in a matrix, signal lines configured to supply a first data pulse and a second data pulse to the respective pixels, the first data pulse being formed of two values of a signal voltage and a first fixed voltage, the second data pulse being formed of two values of the signal voltage and a second fixed voltage, the first fixed voltage being smaller than the second fixed voltage, scan lines configured to supply a selection pulse to the respective pixels, the selection pulse selecting the respective pixels for each row, and power lines configured to supply power to the respective pixels, the drive circuit includes a signal line drive circuit configured to output the first data pulse and the second data pulse alternately to each of the signal lines for each horizontal period, a scan line drive circuit configured to sequentially output the selection pulse to each of the scan lines during one frame period, and a power circuit configured to continuously output a constant voltage to the power lines during the one frame period.

7. The electronic apparatus according to claim 6, wherein a first selection pulse indicates the selection pulse applied to each of the scan lines when the second fixed voltage is applied to each of the signal lines, a second selection pulse indicates the selection pulse applied to each of the scan lines when the signal voltage is applied to each of the signal lines, the scan line drive circuit outputs the selection pulse to each of the scan lines to allow an interval between the first selection pulse and the second selection pulse in an n-th horizontal period to be shorter than an interval between the first selection pulse and the second selection pulse in an n+1-th horizontal period, during a first frame period, and the scan line drive circuit outputs the first selection pulse and the second selection pulse to each of the scan lines to allow the interval between the first selection pulse and the second selection pulse in the n-th horizontal period to be longer than the interval between the first selection pulse and the second selection pulse in the n+1-th horizontal period, during a second frame period subsequent to the first frame period.

8. A drive circuit configured to drive a display panel, the display panel including a plurality of pixels arranged in a matrix, signal lines configured to supply a first data pulse and a second data pulse to the respective pixels, the first data pulse being formed of two values of a signal voltage and a first fixed voltage, the second data pulse being formed of two values of the signal voltage and a second fixed voltage, the first fixed voltage being smaller than the second fixed voltage, scan lines configured to supply a selection pulse to the respective pixels, the selection pulse selecting the respective pixels for each row, and power lines configured to supply power to the respective pixels, the drive circuit comprising:

a signal line drive circuit configured to output the first data pulse and the second data pulse alternately to each of the signal lines for each horizontal period;

a scan line drive circuit configured to sequentially output the selection pulse to each of the scan lines during one frame period; and a power circuit configured to continuously output a constant voltage to the power lines during the one frame period.

9. The drive circuit according to claim 8, wherein a first selection pulse indicates the selection pulse applied to each of the scan lines when the second fixed voltage is applied to each of the signal lines, a second selection pulse indicates the selection pulse applied to each of the scan lines when the signal voltage is applied to each of the signal lines, the scan line drive circuit outputs the selection pulse to each of the scan lines to allow an interval between the first selection pulse and the second selection pulse in an n-th horizontal period to be shorter than an interval between the first selection pulse and the second selection pulse in an n+1-th horizontal period, during a first frame period, and the scan line drive circuit outputs the first selection pulse and the second selection pulse to each of the scan lines to allow the interval between the first selection pulse and the second selection pulse in the n-th horizontal period to be longer than the interval between the first selection pulse and the second selection pulse in the n+1-th horizontal period, during a second frame period subsequent to the first frame period.

* * * * *